US006328816B1

(12) United States Patent
Carlson et al.

(10) Patent No.: US 6,328,816 B1
(45) **Date of Patent: *Dec. 11, 2001**

(54) COMPOSITION AND METHOD FOR DEGREASING METAL SURFACES

(75) Inventors: Lawrence R. Carlson, Waterford; John R. Pierce, Huntington Woods, both of MI (US)

(73) Assignee: Henkel Corporation, Gulph Mills, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/000,297

(22) PCT Filed: May 21, 1996

(86) PCT No.: PCT/US96/06881

§ 371 Date: Jan. 26, 1998

§ 102(e) Date: Jan. 26, 1998

(87) PCT Pub. No.: WO97/05222

PCT Pub. Date: Feb. 13, 1997

Related U.S. Application Data

(60) Provisional application No. 60/001,412, filed on Jul. 25, 1995.

(51) Int. Cl.[7] ..... C23G 5/02; C23G 5/032; B08B 3/04

(52) U.S. Cl. ..... 134/40; 134/2; 134/41; 510/245; 510/254

(58) Field of Search ..... 510/174, 245, 510/254–256, 258–260, 264–265, 267, 269, 271, 273–274, 363, 365, 400–402, 405, 421, 424, 426, 433, 465–466, 499, 501, 504; 134/2, 40–41

(56) References Cited

U.S. PATENT DOCUMENTS

| | | | | |
|---|---|---|---|---|
| 4,085,059 | * | 4/1978 | Smith et al. | 252/118 |
| 4,113,498 | * | 9/1978 | Rones et al. | 106/14.13 |
| 4,569,782 | * | 2/1986 | Disch et al. | 510/395 |
| 4,578,208 | | 3/1986 | Geke et al. | 252/135 |
| 5,093,031 | * | 3/1992 | Login et al. | 514/68 |
| 5,252,245 | * | 10/1993 | Garabedian, Jr. et al. | 510/424 |
| 5,614,027 | * | 3/1997 | Dunn et al. | 134/2 |
| 5,634,979 | * | 6/1997 | Carlson et al. | 134/3 |
| 5,736,495 | * | 4/1998 | Bolkan et al. | 510/202 |

FOREIGN PATENT DOCUMENTS

| | | | |
|---|---|---|---|
| 4102709 | | 7/1992 | (DE) . |
| WO 9308252 | | 4/1993 | (WO) . |
| WO 9403571 | | 2/1994 | (WO) . |
| WO 94/23003 | * | 10/1994 | (WO) . |
| WO 9423003 | | 10/1994 | (WO) . |
| WO 9603483 | | 4/1995 | (WO) . |
| WO 9609366 | | 7/1995 | (WO) . |
| WO 9521238 | | 8/1995 | (WO) . |

* cited by examiner

*Primary Examiner*—Yogendra N. Gupta
*Assistant Examiner*—Brian P. Mruk
(74) *Attorney, Agent, or Firm*—Wayne C. Jaeschke; Stephen D. Harper; Lance G. Johnson

(57) ABSTRACT

The invention is a cleaning solution for degreasing metal articles which contains water soluble, N-alkyl substituted amides in which the alkyl substituent has from 6 to 22 carbon atoms and at least one of (i) amine oxide surfactants, (ii) non-ionic water soluble nonionic surfactants with molecules containing a polyoxyalkylene block, and (iii) alkali stable anionic, or both anionic and amphoteric, surfactants. Preferred compositions of the invention can replace a vapor degreasing process for cleaning oil, grease, and waxy-type contaminants from metal articles to the level of cleanliness required in the aerospace industry.

3 Claims, No Drawings

COMPOSITION AND METHOD FOR DEGREASING METAL SURFACES

This application is a 371 of Pct/US 96/06881 filed May 11, 1996, and claims benefit of Provisional Application Ser. No. 60/001412 filed Jul. 25, 1995.

BACKGROUND OF THE INVENTION

1. Field of the Invention

The invention relates to a process for degreasing metal surfaces, especially aluminum and aluminum alloy metal surfaces. Aqueous compositions and methods of the invention provide satisfactory degreasing of metal surfaces for use in the aerospace industry. The compositions and methods of the present invention can be utilized to replace vapor degreasing operations in many metal fabricating operations.

2. Statement of Related Art

Many mechanical operations such as stamping, cutting, welding, grinding, drawing, machining, and polishing are used in the metal working industry to provide shaped metal articles. In metal working operations, lubricants, antibinding agents, machining coolants and the like are normally utilized to prevent binding and sticking of the tools to the metal articles in the various metal working operations. The lubricants, coolants, and antibinding agents and the additives present in these compositions usually leave an oily, greasy, and/or waxy residue on the surface of the metal which has been worked. The residue normally should be removed before the worked articles are given a protective surface finish or incorporated into a finished assembly.

Until the present time, it has been customary to clean oily, greasy, and/or waxy residues from metal articles by a vapor degreasing process. In a vapor degreasing process, the metal articles, at a temperature below the condensing temperature of a solvent for the oily, greasy and/or waxy residues, are suspended in vapors of refluxing solvent. The refluxing solvent condenses on the surface of the metal article, and the liquid solvent dissolves the oily, greasy, and/or waxy residues on the surface of the metal article. The condensing solvent with the high dissolving power for the contaminants to be removed from the surface of the metal article condenses on the surface of the article, dissolves the contaminants, and is returned to the source of the solvent vapor.

Solvents such as methyl ethyl ketone, methylene chloride, 1,1,1-trichloroethane, trichloroethylene, perchloroethylene, and the like are normally used in the vapor degreasing process. Since the oily, greasy, and/or waxy soils removed from the metal articles generally have a boiling point substantially higher than the boiling point of the refluxing solvent, the metal articles are contacted with a condensed solvent containing only relatively small quantities of the contaminants to be dissolved and removed from the metal articles.

Vapor degreasing is technically effective but economically and environmentally disadvantageous. The solvents are expensive, can be environmental pollutants, and require costly methods for reclamation and disposal. Special apparatus and processes are required to reclaim used solvent for reuse and to prevent solvent vapors from escaping from the vapor degreasing process. The solvent vapors are often hazardous to human health and some of them are suspected of promoting degradation of the earth's ozone layer. In view of the drawbacks in the use of the vapor degreasing process, many attempts have been made to replace vapor degreasing with aqueous based cleaning compositions. However, to date the aqueous cleaning methods have not been entirely satisfactory, particularly in preparing metallic surfaces of relatively low density, such as those of aluminum and aluminum alloys, for use in the aerospace industry, where the requirements for cleaning are particularly stringent.

DESCRIPTION OF THE INVENTION

Object of the Invention

A major object of the invention is to provide a water-based liquid cleaner that is capable of degreasing normally worked metal articles effectively enough to meet the stringent standards established for aluminum and its alloys in the aerospace industry. Other objects are to provide a more economical process, a faster process and/or one requiring less expensive equipment for operation on a large scale, and to reduce hazards of fire and of damage to the environment from discharge of used cleaner.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percents, "parts of", fractions, ratio values, and the like are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of electrically neutral constituents in chemical terms refers to the constituents at the time of addition to any combination specified in the description and/or at the time of formation within such a combination by known chemical reactions as specified in the description, and does not necessarily preclude other chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its variations may be applied to elemental, ionic, and any other chemical species defined by number and type of atoms present, as well as to compounds with well defined molecules.

Also, unless the context requires otherwise to be sensible or there is an express contrary indication, such as the use of the qualifier "pure" or the like, the term "aluminum" when used hereinafter to describe a substrate being treated by or suitable to be treated by a process according to this invention is to be understood to include pure aluminum and all the alloys of aluminum that contain at least 55% of pure aluminum.

Summary of the Invention

The working and concentrate metal cleaning compositions of the invention comprise, preferably consist essentially of, or more preferably consist of, water and the following dissolved, stably dispersed, or both dissolved and stably dispersed components:

(A) a surfactant component including at least one member selected from the group consisting of:

(A.1) amine oxide surfactants;

(A.2) nonionic surfactant molecules, exclusive of amine oxide molecules, that contain a moiety conforming to the general chemical formula $-(C_mH_{(2m-z)}X_zO)_v$, wherein m has the value 2, 3, or 4, preferably 2 or 3, more preferably 2; z represents an integer with a value from 0 to 2m; X represents a halogen atom, and if z has a value of more than 1, may represent the same or a different halogen atom for each X; and v represents a positive integer; and (A.3) anionic, amphoteric, and both anionic and amphoteric surfactants, exclusive of any previously recited components, that are all alkali stable;

(B) a component selected from the group consisting of molecules, exclusive of molecules that are part of component (A), that include a moiety corresponding to general chemical formula I:

(I)

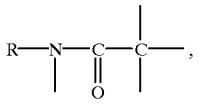

where R represents a monovalent aliphatic, preferably straight chain, moiety with the chemical formula $—C_nH_{(2n+1-y)}F_y$, wherein n is an integer from 6 to 22, and y is an integer from 0 to (2n+1); and, optionally, one or more of the following components:

(C) a component of alkalinizing agent, often alternatively known in the detergent art as "builder", that is not part of any of the previously recited components;

(D) a component of organic compounds that (1) are not part of any of the previously recited components, (2) are liquid at 25° C., and (3) are selected from the group consisting of (3.1) compounds made up of molecules that (3.1.1) contain at least two hydroxyl oxygen atoms and (3.1.2) otherwise contain (3.1.2.1) only carbon and hydrogen and, optionally, halogen atoms, or preferably (3.1.2.2) only carbon and hydrogen atoms; and (3.2) compounds made up of molecules that (3.2.1) contain at least two ether oxygen atoms and (3.2.2) otherwise contain (3.2.2.1) only carbon, hydrogen, hydroxyl oxygen, and/or halogen atoms, or preferably (3.2.2.2) only carbon and hydrogen atoms and, optionally, not more than one hydroxyl oxygen atom; and (E) a component of hydrotroping agent that is not part of any of the previously recited components;

(F) a component of corrosion inhibitors that are not part of any of the previously recited components; and (G) a component of sequestering agents that are not part of any of the previously recited components. In this description, "stably dispersed" means that the component so described can be dispersed by mixing, within 1 hour of its introduction into the liquid phase in which the component in question is described as stably dispersed, to produce a liquid mixture which has only one bulk phase detectable with unaided normal human vision and does not spontaneously develop any separate bulk phase detectable with normal unaided human vision within 24 hours, or preferably, with increasing preference in the order given, within 7, 30, 60, 90, 120, 180, 240, 300, or 360 days, of storage without mechanical agitation at 25° C. after being initially mixed. (The word "bulk" in the preceding sentence means that, to be considered as a bulk phase, a phase must occupy at least one volume of space that is sufficiently large to be visible with unaided normal human vision and is separated from at least one other phase present in the dispersion by a boundary surface that can be observed with unaided normal human vision. Therefore, a change of the composition from clear to hazy or from hazy to clear does not indicate instability of a dispersion within this definition, unless a separate liquid or solid phase develops in the mixture in at least one volume large enough to see independently with unaided normal human vision.) Also in this description, "alkali stable" when referring to a surfactant means that the surfactant is capable of coexisting at its critical micelle concentration in an aqueous solution also containing at least, with increasing preference in the order given, 5, 10, 15, 20, 25, or 29% of sodium hydroxide, without any chemical reaction (except possibly for reversible neutralization) between the surfactant and the sodium hydroxide and without the formation of any separate bulk phase detectable with normal unaided human vision within 24 hours, or preferably, with increasing preference in the order given, within 7, 30, 60, 90, 120, 180, 240, 300, or 360 days, of storage without mechanical agitation at 25° C. after being initially mixed.

Compositional embodiments of the invention include liquid compositions ready for use as such in cleaning (i.e., "working compositions") and concentrates suitable for preparing working compositions by dilution with water. Concentrates may be single package or multiple, usually dual, package in nature. A multiple package type of concentrate is preferred when not all of the ingredients desired in the working composition are sufficiently soluble or stably dispersible at the higher concentrations required for a one package concentrate composition, which is otherwise preferred. For example, at some concentrations, preferred polymeric organic sequestering agents and some preferred alkalinizing components can not be jointly solubilized. The two components are then placed in separate packages with other portions of the formulation so that stable solutions or dispersions can be formed after mixing and dilution. A two package concentrate system has some advantages in that the two components can be mixed in different proportions to provide more effective cleaning for particular soils, soil combinations, and/or types of substrate to be cleaned. Ordinarily, however, at least for users for whom cleaning requirements do not vary greatly, single package concentrates are preferred because they are more convenient.

Process embodiments of the invention include at a minimum using a working composition according to the invention to remove soils from a metal substrate, and they may include other process steps, particularly those which are conventional in themselves preceding or following vapor degreasing in the prior art.

Compositions of the present invention are particularly useful for cleaning aluminum substrates, but are also useful for cleaning articles fabricated from metals such as steel, stainless steel, magnesium, titanium, tantalum, and other metals which are machined or worked during their fabrication into useful articles.

The composition and the method of the present invention, especially in their preferred embodiments, can provide removal of oily, greasy, and/or waxy residue from metal substrates to meet Boeing Aircraft Corporation ("BAC") 5763 PSD-6-14 criteria. Boeing Aircraft Corporation criteria requires the removal of all light oil (3-IN-1™ Oil), lipstick, axle grease, COSMOLENE™, black SHARPIE™ marker, red MAGIC MARKER™, BAYCO™ 363, CINFLO™, STAYPUT™ 350, CYTAL™ 81, MEROPA™ 460 and HD32 WAY OIL™ from the metal surface. The most preferred embodiments of the present invention can remove the above soils, meet the requirement for maximum etching weight loss on seven different substrates, meet the requirement of the sandwich corrosion versus DARACLEAN™ 282 test, meet requirements for avoiding inter-granular attack, corrosion resistance, paint adhesion, avoiding hydrogen embrittlement (steel), stress corrosion cracking, hydrogen content, and operating bath temperature. However, compositions according to the present invention can be particularly useful even when requirements for cleaning are not as stringent as those in the Boeing BAC 5763 criteria.

In addition to the above noted necessary and optional materials, compositions of the present invention can additionally contain germiicides, preserving agents and the like.

A composition of the present invention does not generally require the presence of a foam suppressing agent. All of the preferred types of surfactants in a composition according to the invention, except possibly for amine oxides, are readily available commercially in relatively low foaming embodiments. Generally, if metal articles are to be degreased by immersion in the degreasing solution, the use of low-foaming surfactants is not required. However, if the degreasing solution is to be sprayed on the metal articles, it is generally preferred to prepare the degreasing compositions from low-foaming or moderate-foaming surfactant materials, rather than using surfactants known to be high foaming and adding a foam suppressing agent. For example, the NEODOL™ linear alcohol ethoxylates described in some of the examples below are among the least prone to foaming of any of the surfactants suitable for component (A.2) and are accordingly preferred for degreasing according to the invention when using a spraying technique. The use of separate foam suppressing agents, however, is within the broad scope of the invention.

Description of Preferred Embodiments

Working compositions and processes according to this invention are effective over a wide range of pH values. For primary degreasing prior to most subsequent operations, an alkaline working composition according to the invention is preferred because it generally effects adequate degreasing more rapidly. The particular degree of alkalinity that is most preferred generally requires a compromise between quick degreasing, which is favored by greater alkalinity, and minimizing corrosion, which, at least for aluminum substrates, is favored by lower alkalinity. The presence of silicates in a working composition according to the invention is very advantageous in reducing corrosion at higher alkalinity levels, as noted in further detail below, but silicates often leave a slight surface residue which is unimportant for some types of further processing but unacceptable for others.

For degreasing objects of aluminum alloys intended for manufacture of aerospace vehicles, very low corrosion by the degreasing composition is required and the presence of silicates is acceptable, inasmuch as any residue that they may leave is removed by and/or is harmless in the further processing that such degreased objects undergo. For these aerospace industry applications of the invention when rapid degreasing is desired, the pH of a working composition according to the invention preferably is at least, with increasing preference in the order given, 9.3, 9.5, 9.7, 9.9, 10.1, 10.3, 10.5, 10.7, 10.9, 11.0, 11.1, 11.2, or 11.3 and independently preferably is, with increasing preference in the order given, not more than 12.0, 11.9, 11.8, or 11.7. For other applications where the presence of silicates in the working compositions is acceptable and corrosion minimization is less important than in aerospace applications, pH values up to at least 12.7 are satisfactory and may be preferred for working compositions because they effect relatively rapid degreasing.

If silicate residues on the degreased metal surfaces are not acceptable and the metal surface being degreased is predominantly aluminum, the pH of a working composition preferably is not more than, with increasing preference in the order given, 8.9, 8.8, 8.7, 8.6, or 8.5, because at higher pH values corrosion of the degreased aluminum object is likely to be higher than desirable. In order to minimize corrosive attack, even working compositions with a mildly acidic pH may be advantageously used to degrease many aluminum substrates, and in one particular specialized embodiment of the invention in which silicates are not included in the compositions according to the invention in order to minimize residues, the pH of a working composition preferably is not more than 6.0 and independently preferably is not less than 4.5.

Component (A.1) when used is preferably selected from the group consisting of molecules conforming to the general formula $R^1R^2R^3NO$, wherein $R^1$ represents an alkyl, aryl, or alkylaryl moiety preferably having at least, with increasing preference in the order given, 6, 8, 10, or 12 carbon atoms and independently preferably having not more than, with increasing preference in the order given, 22, 20, 18, or 16 carbon atoms; and each of $R^2$ and $R^3$, which may be the same or different, represents an alkyl, aryl, or alkylaryl moiety having no more than, with increasing preference in the order given, 8, 6, 4, 3, 2, or 1 carbon atom(s). An $R^1$ moiety independently more preferably is an alkyl moiety, without any aryl groups, and independently more preferably has no substituent groups, although it may have halogen or ether substituent groups within the broad scope of the invention. An $R^2$ or $R^3$ moiety independently more preferably is an alkyl group. The use of component (A.1) is preferably minimized in compositions according to the invention that are to be used by spraying because of the likelihood of excessive foaming.

The nonionic substances required for component (A.2) when used preferably are selected from the group consisting of (A.2.1) (A.2.1.1) block copolymers of propylene oxide and ethylene oxide, (A.2.1.2) ethoxylated and both ethoxylated and propoxylated fatty alcohols, (A.2.1.3) ethoxylated and both ethoxylated and propoxylated alkyl phenols, and (A.2.1.4) ethoxylated alkyl or aryl moieties, all of which constituents of subsubcomponent (A.2.1) optionally can be modified by capping the terminal ethoxy or propoxy group with a low molecular weight capping moiety generally having 1 to 4 carbon atoms; (A.2.2) neutral esters of a fatty acid and/or fatty alcohol that include a polyoxyethylene block in their molecular structure; (A.2.3) ethoxylated fatty amines; and (A.2.4) ethoxylated monoglycerides and diglycerides. Preferably, the nonionic surfactants utilized in the practice of the present invention are stable and soluble in the working compositions that contain them. Independently, these nonionic surfactants more preferably are selected from molecules conforming to the general formula $R^4$-$(C_2H_4O)_w$-$R^5$, where $R^4$ represents an alkyl, aryl, or alkylaryl moiety preferably having at least, with increasing preference in the order given, 5, 6, 7, 8, or 9 carbon atoms and independently preferably having not more than, with increasing preference in the order given, 22, 20, 18, 16, 14, 13, or 12 carbon atoms; $R^5$ represents hydrogen or an alkyl, aryl, or alkylaryl group having no more than, with increasing preference in the order given, 8, 6, 4, 3, 2, or 1 carbon atom(s); and w is a number having an average value that is at least, with increasing preference in the order given, 4.0, 5.0, 6.0, 7.0, 8.0, or 8.7 and independently preferably is not more than, with increasing preference in the order given, 14.0, 13.0, 12.0, 11.0, 10.0, 9.6, or 9.3. Each of the $R^4$ and $R^5$ moieties independently more preferably is an alkyl moiety, without any aryl groups, and independently more preferably is primary (i.e., has two hydrogen and/or halogen atoms bonded to the carbon atom in the moiety with the free valence) and independently more preferably has no substituent groups, although it may have halogen or ether substituent groups within the broad scope of the invention, except that the most preferred $R^5$ moiety is hydrogen.

Independently of other preferences, component (A.2) when used preferably is selected from surfactants with a hydrophile-lipophile balance (hereinafter usually abbreviated as "HLB") value that is not less than, with increasing preference in the order given, 9.6, 10.0, 10.4, 10.8, 11.2, 11.6, 11.8, 12.0, 12.2, or 12.4 and independently preferably is not more than, with increasing preference in the order given, 16, 15.0, 14.6, 14.2, 13.8, 13.6, 13.4, or 13.3. Suitable commercially available nonionic surfactants with an HLB within this range for use in component (A.2) as defined above include materials such as MACOL™ OLA-4; ALKASURF™ LA-EP45; CHEMAL™ LA-9; FLO MO™ 6 D; PLUROFAC™ R AR20; ALKASURF™ OP-5; TRITON™ DF-12, N-87, and DF-18; ALKAMUL™ 400 MO; TERGITOL™ TMN-6; PLURONIC™ L43; and NEODOL™ 25-7, 1-73B, 91-8; and the like.

Component (A.3) when used preferably is selected from the group consisting of Alkali Surfactant JEN 2700™, commercially supplied by Tomah Chemical Products, Milton, Wis. and reported by its supplier to be a solution in water of about 35% of its surfactant ingredient, mono sodium salt of iso-decyloxypropylaminodipropionic acid, an amphoteric surfactant, and SURMAX™ CS-504, -515, -521, -522, -555, -586, -634, -684, -727, -772, and -786, all commercially available from Chemax, Inc., Greenville, S.C. and reported by their supplier to be amphoteric-anionic alkali stable surfactants that include organic esters, and/or salts of organic esters, of phosphoric acid, with other compositional information being proprietary.

In a concentrate composition according to the invention, the total amount of component (A) preferably is at least, with increasing preference in the order given, 25, 35, 40, 45, 50, 55, 60, 65, 70, 75, 80, 85, 90, 95, 100, 105, 110, 115, 120, or 125 grams per kilogram (hereinafter usually abbreviated "g/kg") of total concentrate, and independently preferably is not more than, with increasing preference in the order given, 500, 400, 350, 300, 275, 250, 225, 200, 185, 175, 165, or 160 g/kg of total concentrate.

In general, in a working composition according to the invention, the concentration of any component (except water) for which a preferred concentration in a concentrate composition is specified herein is preferably 0.10 times the concentration specified for the same component in the concentrate composition. For example, in a working composition, the concentration of component (A) preferably is at least, with increasing preference in the order given, 2.5, 3.5, 4.0, 4.5, 5.0, 5.5, 6.0, 6.5, 7.0, 7.5, 8.0, 8.5, 9.0, 9.5, 10.0, 10.5, 11.0, 11.5, 12.0, or 12.5 g/kg of total working composition, and independently preferably is not more than, with increasing preference in the order given, 50, 40, 35, 30, 27.5, 25, 22.5, 20, 18.5, 17.5, 16.5, or 16.0 g/kg of total working composition. However, for any actual concentrate composition according to the invention, working compositions made by diluting the actual concentrate composition so as to provide any amount of the actual concentrate composition in the range of 5 to 20% of the concentrate composition in the working compositions may be most preferable for a specific application, with lower amounts of the concentrate, within this range, being generally satisfactory and more economical in a working composition when relatively low volumes of soils are to be removed and larger amounts of the concentrate composition, within this range, being more likely to be needed in a working composition to remove heavy soil loads in an economically acceptable time.

Component (B) as specified above preferably is selected from molecules in which the nitrogen and carbon atoms in the moiety according to formula (I) are all part of a five or six membered ring structure, more preferably from the group of N-alkyl-2-pyrrolidones in which the alkyl group is more preferably straight chain and independently preferably has, with increasing preference in the order given, at least 2, 3, 4, 5, 6, 7, or 8 carbon atoms and also independently preferably has, with increasing preference in the order given, not more than 30, 20, 18, 16, 14, 12, 11, 10, or 9 carbon atoms.

In a concentrate composition according to the invention, the concentration of component (B) preferably is at least 2.0, 3.0, 4.0, 5.0, 6.0, 7.0, 8.0, 9.0, 9.5, or 9.9 g/kg of concentrate and, unless component (A) includes at least 20% by weight of component (A.3), more preferably is at least, with increasing preference in the order given, 12, 15, 18, 21, 24, 27, or 29 g/kg. Independently, the concentration of component (B) in a concentrate composition according to the invention preferably is not more than, with increasing preference in the order given, 100, 60, 55, 50, 45, 42, 40, 38, or 36 g/kg of total concentrate, and if the amount of component (A.3) present in the composition is at least 20% of the total of component (A) more preferably, primarily for reasons of economy, is not more than, with increasing preference in the order given, 30, 25, 20, 15, or 11 g/kg. Also independently, the ratio of the amount of component (B) to the amount of component (A) preferably is at least, with increasing preference in the order given, 0.030:1.0, 0.040:1.0, 0.050:1.0, 0.060:1.0, 0.070:1.0, or 0.075:1.0 and, unless component (A) includes at least 20% by weight of component (A.3), more preferably is at least, with increasing preference in the order given, 0.08:1.0, 0.09:1.0, 0.10:1.0, 0.11:1.0, 0.12:1.0, 0.16:1.0, 0.20:1.0, 0.24:1.0, or 0.28:1.0 and independently preferably is, primarily for economic reasons, not more than, with increasing preference in the order given, 0.9: 1.0, 0.8:1.0, 0.7:1.0, 0.6:1.0, 0.50:1.0, 0.45:1.0, or 0.41:1.0, and if the amount of component (A.3) present in the composition is at least 20% of the total of component (A) more preferably, primarily for reasons of economy, is not more than, with increasing preference in the order given, 0.35:1.0, 0.30:1.0, 0.25:1.0, 0.20:1.0, 0.15:1.0, 0.12:1;0, 0.10:1.0, 0.090:1.0, 0.085:1.0, 0.080:1.0, or 0.077:1.0.

When present in a composition according to the invention, alkalinizing component (C) is preferably selected from various inorganic salts and hydroxides known to be useful as "inorganic builders" in cleaning formulations generally. Inorganic builders, except for hydroxides, are generally salts of polyfunctional inorganic acids, such as alkali metal silicates, alkali metal borates, alkali metal carbonates, alkali metal sulfates, alkali metal polyphosphates, alkali metal phosphates, alkali metal orthophosphates, and alkali metal pyrophosphates. Salts such as sodium silicate, sodium metasilicate, sodium orthosilicate, sodium tetraborate, sodium borate, sodium sulfate, sodium carbonate, trisodium phosphate, disodium orthophosphate, sodium metaphosphate, sodium pyrophosphate, and the equivalent potassium salts and sodium and potassium hydroxides and the like are all suitable alkalinizing agents for compositions according to the present invention. Lithium, rubidium, and cesium salts and hydroxides are also suitable, although usually less preferred because of their higher cost, and ammonium salts are technically suitable but are generally avoided because of the chance of loss by volatilization and the accompanying odor nuisance of ammonia fumes. Silicates are highly preferred for the anions of alkalinizing agents, and silicates may advantageously constitute the entire alkalinizing component. Sodium metasilicate in particular is most preferred.

The concentration of silicon atoms from silicates in a concentrate composition according to the invention, especially when silicates are the only alkalinizing agent, preferably is at least, with increasing preference in the order given, 0.05, 0.10, 0.15, 0.20, 0.25, 0.30, 0.32, 0.34, 0.36, or 0.37 moles per kilogram (hereinafter usually abbreviated "M/kg") and independently preferably is not more than, with increasing preference in the order given, 1.0, 0.90, 0.80, 0.70, 0.60, 0.55, 0.50, 0.47, 0.44, 0.42, 0.40, or 0.38 M/kg.

If the pH of a working composition is greater than 9.0 and the composition is to be used for cleaning most high-aluminum alloys, it is highly preferred to include some silicate in the composition as at least part of component (C), in order to avoid the corrosion of aluminum that is likely to result otherwise under such high pH conditions. In particular, in a working composition with a pH higher than 9, the concentration of alkali metal silicate preferably is sufficiently high that the molar ratio of the stoichiometric equivalent as $SiO_2$ of the silicon in the silicate to the stoichiometric equivalent as alkali metal oxide of the total of (i) the alkali metal content in the alkali metal silicate and (ii) any unneutralized alkali metal hydroxide present in the working composition preferably is, with increasing preference in the order given, at least 0.02:1.0, 0.04:1.0, 0.08:1.0, 0.16:1.0, 0.20:1.0, 0.24:1.0, 0.26:1.0, 0.28:1.0, 0.29:1.0, 0.30:1.0, or 0.31:1.0 and independently preferably is, with increasing preference in the order given, not greater than 1.0:1.0, 0.90:1.0, 0.80:1.0, 0.70:1.0, 0.60:1.0, 0.50:1.0, or 0.40:1.0.

Optional solvent component (D) is not ordinarily needed in a composition according to this invention and if not needed is preferably omitted, inasmuch as the extents of emission into the natural atmosphere of most of the chemical substances meeting the criteria for this component are legally restricted. However, in some specialized uses, such solvents may be needed for satisfactory results.

Optional hydrotroping component (E) also is not generally needed in most compositions according to this invention, in part because many of the preferred constituents of component (A) have some hydrotroping effect. Conventional hydrotroping agents such as the salts of alkyl benzene sulfonic acids, particularly of cumene sulfonic acid, are suitable for compositions to accomplish the cleaning purposes of this invention, but because of the later intended use of the substrates to be cleaned, very low tolerances for residual sulfur on the surface are specified for many aerospace applications. Two other types of hydrotropes are therefore preferred, when an additional hydrotrope is needed, for most formulations according to this invention: (i) organic phosphate esters and (ii) alkyl and alkenyl substituted cyclic acid anhydrides, particularly the anhydrides of $C_{4-6}$ terminal dicarboxylic acids substituted with alkyl or alkenyl groups having 6 to 20 carbon atoms. A particularly preferred example of this type of hydrotrope is nonenyl succinic anhydride. These two types are even more preferred in combination with each other, in a ratio of type (i) to type (ii) that preferably is, with increasing preference in the order given, at least 0.1, 0.2, 0.4, 0.6, 0.80, 0.90, 1.00, 1.10, 1.20, 1.30, 1.40, 1.50, or 1.55 and independently preferably is, with increasing preference in the order given, not more than 20, 15, 10, 7, 5, 4, 3, 2.7, 2.4, 2.2, 2.0, 1.9, 1.8, 1.75, 1.70, or 1.65. The amount of hydrotroping agent is not believed to be critical, but in a highly alkaline concentrate with other components at their most preferred levels, the total amount of hydrotroping agent preferably is, with increasing preference in the order given, at least 5, 25, or 50 g/L and independently preferably is, with increasing preference in the order given, not more than 150, 90, or 70 g/L. In working compositions or in concentrates of lower pH, no hydrotroping agent at all is usually needed.

The presence of a corrosion inhibiting effective amount of component (F) in a composition according to the invention is normally preferred. Essentially any organic material known to have a corrosion inhibiting effect on aluminum may be utilized in optional component (F) according to the invention as described above. The organic corrosion inhibitors most useful in the practice of the present invention are generally nitrogen or oxygen containing organic compounds, such as amines, nitro compounds, imidazoles, diazoles, triazoles, carboxylic acids, and the like. Particularly preferred organic inhibitors are aromatic triazoles and their salts. When component (F) is present in a concentrate composition according to this invention and is selected from these organic materials, its concentration preferably is, with increasing preference in the order given, at least 0.001, 0.002, 0.004, 0.008, 0.015, 0.030, 0.060, 0.12, 0.25, 0.35, 0.40, 0.45, 0.48, 0.52, 0.55, or 0.58 g/L and independently, primarily for reasons of economy, preferably is, with increasing preference in the order given, not more than 20, 10, 5, 4.5, 4.0, 3.6, 3.2, 2.8, 2.4, 2.0, 1.9, 1.8, 1.7, or 1.6 g/L.

Alternatively, component (F) may be inorganic, preferably boric acid. When boric acid is the predominant constituent of component (F) and component (F) is present, the concentration of boric acid in a concentrate composition according to the invention preferably is at least, with increasing preference in the order given, 1.1, 2.1, 3.1, 4.1, 5.1, 5.6, 5.8, 6.0, or 6.1 g/kg and, if the pH of the composition is not more than 7.0, more preferably is at least, with increasing preference in the order given, 10, 14, 17, 20, or 22 g/kg; independently, primarily for reasons of economy, the concentration of boric acid in a concentrate composition according to the invention preferably is not more than 75, 50, 40, 30, or 25 g/kg and unless the pH value of the composition is not greater than 7.0 more preferably is not more than, with increasing preference in the order given, 20, 15, 10, 9.0, 8.0, 7.5, 7.0, 6.6, or 6.4 g/kg.

Optional sequestering agent component (G) is not needed or preferable in most compositions according to the invention, but may be useful in certain cases, particularly if the water that forms the bulk of a composition according to the invention is extraordinarily hard and/or a mildly acidic working composition is preferred. Any material recognized in the art as a sequestering agent for aluminum, calcium, and/or magnesium cations in aqueous solution may be used. A particularly preferred type of sequestering agent for one particular embodiment of the invention is a polycarboxylate copolymer of the type generally available commercially and often known as an "organic builder". Materials such as Polymer QR1362-PMN and ACUSOL™ 102, both from Rohm and Haas, have been found to be useful for this purpose in the practice of the present invention. In a working composition according to this invention, the concentration of polycarboxylate copolymer, if needed, preferably is, with increasing preference in the order given, at least 0.1, 0.2, 0.4, 0.8, 1.5, 2.0, 2.5, 2.8, 3.1, 3.4, 3.6, 3.7, 3.8, 3.9, 4.0, or 4.1 g/L and independently preferably is, with increasing preference in the order given, not more than 100, 50, 38, 28, 24, 20, 16, 14, 13, 12, or 11 g/L.

Other preferred sequestering agents for another particular embodiment of the invention include sufficiently water-soluble organic acids, and salts of acids, that contain at least two —OH moieties (which may or may not be part of carboxyl moieties) positioned within the acid molecule in such a way that the two oxygen atoms are separated from each other by at least two carbon atoms. Preferred examples of such acids include nitrilotriacetic acid ("NTA"), ethylene diamine tetraacetic acid ("EDTA"), and, particularly preferred, citric acid.

Independently, the total concentration of all sequestering agents, if needed or desired in a composition according to the invention, preferably is, with increasing preference in the order given, not more than 100, 50, 38, or 28 g/L and unless the composition has a pH less than 7.0 more preferably, primarily for reasons of economy, is not more than, with increasing preference in the order given, 24, 20, 16, 14, 13, or 12 g/L.

Metal articles to be degreased should be contacted with the aqueous degreasing composition of the present invention at a sufficient temperature for a sufficient time to be effective for degreasing. For removing average type soils, the temperature during contact preferably is, with increasing preference in the order given, not less than 20, 25, 28, 30, 32, 34, or 36° C. and independently preferably is, with increasing preference in the order given, not more than 80, 75, 70, 65, 60, 55, 50, 45, or 40° C. Higher temperatures generally provide a more rapid degreasing and can be necessary when the soil comprises high melting point waxy type materials. Under normal conditions, the time of contact between the metal to be degreased and the working composition according to this invention preferably is, with increasing preference in the order given, not less than 1, 2, 4, 8, 10, 12, 13, or 14 minutes and independently preferably is, with increasing preference in the order given, not more than 120, 90, 60, 50, 40, 30, 27, 24, 22, 20, 18, or 16 minutes.

The compositions and processes of the present invention are particularly useful to replace vapor degreasing of aluminum articles for use in the aerospace industry. However, the compositions and processes of the present invention are not limited to degreasing of aluminum articles but can be applied to steel, stainless steel, magnesium and magnesium alloys, titanium, tantalum, and the numerous alloys which are utilized in rail cars, aircraft, missiles, space vehicles and the like. The compositions of the present invention can be utilized to degrease and clean extruded aluminum and magnesium articles, forged steel, stainless steel, machined articles such as engine blocks, auto transmission parts, rocket fuel tanks, aircraft panels, and other metal articles which have been machined and require degreasing before they can be assembled or a protective coating applied.

As is well understood in the art, after a vapor degreasing operation or contact with the composition of the present invention to degrease the article, the article can be processed in other usual steps such as alkaline or acid cleaning, deoxidizing, conversion coating, a conversion-coating-improving wash coat or "sealer", such as a chromium wash step, and, if required, the article can be coated with an organic or inorganic protective coating. All of the additional steps are well known in the art and may be required by a particular utility for the article which has been degreased. However, some metals will not require additional protective treatment and can be utilized after rinsing and, if required, an additional treatment with a caustic or acid cleaner to remove any residue which remains from degreasing according to this invention.

The following examples illustrate the compositions and methods of the present invention. The examples are for illustrative purposes only and are not intended to limit the invention.

Concentrate, Working Composition, and Process Examples

The ingredients and amounts of each ingredient used in six concentrate compositions and the pH value of a corresponding working composition consisting of a 20% by volume solution of the concentrate composition in deionized water are shown in Table 1 below.

TABLE 1

CONCENTRATE COMPOSITIONS ACCORDING TO THE INVENTION

| | Grams of Ingredient per Kilogram of Concentrate | | | | | |
|---|---|---|---|---|---|---|
| Ingredient | 1 | 2 | 3 | 4 | 5 | 6 |
| CHEMAL ™ LA-9 surfactant | 100 | 0 | 0 | 0 | 100 | 0 |
| SURMAX ™ CS-684 surfactant | 30 | 0 | 0 | 0 | 30 | 60 |
| Alkali Surfactant JEN 2700 ™ | 13 | 0 | 0 | 0 | 13 | 0 |
| NEODOL ™ 91-8 surfactant | 0 | 100 | 0 | 0 | 0 | 200 |
| NEODOL ™ 1-73B surfactant | 0 | 30 | 0 | 0 | 0 | 60 |
| RHODAMAX ™ LO surfactant | 0 | 0 | 300 | 200 | 0 | 0 |
| Polyglycol E-400 | 0 | 0 | 0 | 100 | 0 | 0 |
| N-octyl-2-pyrrolidone | 10 | 30 | 35 | 20 | 10 | 12 |
| Sodium metasilicate pentahydrate | 80 | 80 | 100 | 50 | 80 | 0 |
| 60% Solution in water of $K_4P_2O_7$ | 0 | 0 | 0 | 50 | 0 | 0 |
| 45% Solution in water of KOH | 0 | 0 | 0 | 0 | 0 | 60 |
| COBRATEC ™ 725 | 0 | 0 | 1 | 2 | 0 | 0 |
| Citric Acid | 0 | 0 | 0 | 0 | 0 | 26 |
| Technical granular boric acid | 0 | 0 | 0 | 0 | 6 | 22 |
| Deionized Water | -------- Balance in all concentrates -------- | | | | | |
| pH of Corresponding Working Composition | 11.7 | n.m. | 12.7 | 12.5 | $11.3_5$ | 4.9 |

Abbreviation for Table 1
n.m. = not measured.

The N-octyl pyrrolidone used as shown in Table 1 was a commercial product, SURFADONE™ LP-100, from ISP Technologies, Inc., Wayne, N.J. The boric acid used as shown in Table 1 was a commercial product of U.S. Borax, Inc., Rosemont, Ill., reported by its supplier to have a boron content stoichiometrically equivalent to from 99.9 to 100.9% of $H_3BO_3$. The chemical nature and/or commercial sources of the other ingredients in Table 1 not identified there or earlier in this description were as follows:

NEODOL™ 91-8 and 1-73B surfactants were both commercially supplied from Shell Chemical Co. The former is reported by its supplier to be ethoxylates of linear primary alcohols with from 9 to 11 carbon atoms per molecule before ethoxylation, an average of 8 ethylene oxide residues per molecule after ethoxylation, and an HLB value of 12.5. The latter is reported by its supplier to be a blend of ethoxylates of $C_{11}$ primary alcohol with an overall average of 5.6 ethylene oxide residues per molecule, achieved by blending two separate ethoxylates with average numbers of ethylene oxide residues per molecule of 3 and 7, and to have an overall HLB value of 11.2–12.3.

RHODAMAX™ LO was commercially supplied by Rhône-Poulenc and is reported by its supplier to be a 29–31% solution in water of $C_{10-16}$ alkyldimethylamine oxides. Polyglycol E400 is a commercial form of polyethylene glycol with an average molecular weight of 400, supplied by Van Waters & Rogers of Kirkland, Wash.

COBRATEC™ 725 was commercially supplied by PMC Specialties Group, Cincinnati, Ohio and is reported by its supplier to be a triazole derivative corrosion inhibitor. The sodium metasilicate pentahydrate used was supplied by Van Waters & Rogers of Kirkland, Wash. under the trade name UNIFLO™ 26. The citric acid used was commercially supplied by Harrmann & Reimer Corp., Elkhart, Ind. and was reported by the supplier to be 100% anhydrous citric acid.

Aqueous solutions of 5, 10, 15, and 20 volume % of each concentrate shown in Table 1 are prepared and tested at 49 and 60° C. for cleaning aluminum panels soiled with standardized amounts of ink, lipstick, COSMOLENE™ petroleum jelly, and axle grease. Panels are immersed for 10 to 15 minutes in a container of the working composition, unless it becomes visually apparent that all the soil has been removed in less than 10 minutes. In some instances, no agitation is used during this period of immersion; in other instances, the mild agitation provided by a magnetic stirring bar moving at 200 revolutions per minute on the bottom of the container is used. The panels are then removed from contact with the working degreasing composition according to the invention, rinsed with tap water, and examined. Highly effective removal of all the standard soils is achieved. No etching of the aluminum panels is observed by visual inspection or by the etch rate test according to Boeing Standard Specification 5763. The working compositions corresponding to Concentrate 5 also pass all BAC corrosion tests required for aerospace vehicle components.

What is claimed is:

1. A process for removing oily, greasy, or waxy soil from an aluminum surface, said process comprising steps of:

(I) contacting the aluminum surface at a pH within the range of 4.5–6 with an aqueous liquid composition that is free of silicates and comprises:

(A) an amine oxide surfactant; and (B) a component selected from the group consisting of molecules, exclusive of molecules that are part of component (A), that include a moiety corresponding to general chemical formula I:

(I)

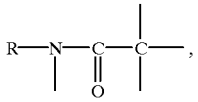

where

R represents a monovalent aliphatic moiety with the chemical formula $—C_nH_{(2n+1-y)}F_y$, wherein n is an integer from 6 to 22, and y is an integer from 0 to (2n+1)

for a sufficient time at a sufficient temperature with sufficient relative motion between the aluminum surface and the aqueous liquid composition to transfer at least part of the oily, greasy, or waxy soil from the metal surface to suspension or solution in the aqueous liquid composition.

2. A process for removing oily, greasy, or waxy soil from an aluminum metal surface, said process comprising steps of:

contacting the aluminum metal surface at a pH within the range of 4.5 to 6 with an aqueous liquid composition that is free of silicates and comprises:

(A) a component selected from the group consisting of:

(A.1) amine oxide surfactants; and (A.2) nonionic surfactants, other than amine oxide surfactants, said nonionic surfactants having a hydrophile-lipophile balance (HLB) value from about 9.6 to about 16 and which contain a moiety conforming to the chemical formula $$-(C_mH_{(2m-z)}X_zO)_v-,$$

wherein m has the value 2, 3, or 4;

z represents an integer with a value from 0 to 2m;

x represents a halogen atom, and if z has a value of more than 1, may represent the same or a different halogen atom for each x; and v represents a positive integer; and (B) a component selected from the group consisting of molecules, exclusive of molecules that are part of component (A), that include a moiety corresponding to general chemical formula I:

(I)

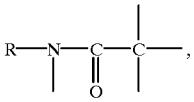

where

R represents a monovalent aliphatic moiety with the chemical formula $—C_nH_{(2n+1-y)}F_y$, wherein n is an integer from 6 to 22, and y is an integer from 0 to (2n+1); and (C) optional alkalinizing agents; hydrotroping agents; corrosion inhibitors; and sequestering agents, for a sufficient time at a sufficient temperature with sufficient relative motion between the metal surface and the aqueous liquid composition to transfer at least part of the oily, greasy, or waxy soil from the metal surface to suspension or solution in the aqueous liquid composition.

3. A process for removing oily, greasy, or waxy soil from an aluminum metal surface, said process comprising steps of:

(I) contacting the aluminum metal surface at a pH within the range of 4.5 to 6 with an aqueous liquid composition that is free of silicates and comprises:

(A) a component selected from the group consisting of:

(A.1) amine oxide surfactants; and (A.2) nonionic surfactants, other than amine oxide surfactants, said nonionic surfactants having a hydrophile-lipophile balance (HLB) value from about 9.6 to about 16 and which contain a moiety conforming to the chemical formula $$-(C_mH_{(2m-z)}X_zO)_v-,$$

wherein m has the value 2, 3, or 4;

z represents an integer with a value from 0 to 2m;

x represents a halogen atom, and if z has a value of more than 1, may represent the same or a different halogen atom for each x; and v represents a positive integer; and (B) a component selected from the group consisting of molecules, exclusive of molecules that are part of component (A), that include a moiety corresponding to general chemical formula I:

(I)

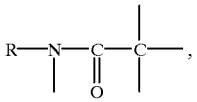

where

R represents a monovalent aliphatic moiety with the chemical formula $$-C_nH_{(2n+1-y)}F_y,$$

wherein n is an integer from 6 to 22, and y is an integer from 0 to (2n+1); and (C) an alkalinizing agent that is not part of any of the previously recited components;

(D) a hydrotroping agent that is not part of any of the previously recited components;

(E) a corrosion inhibitor that is not part of any of the previously recited components; and (F) a sequestering agent that is not part of any of the previously recited components.

* * * * *